United States Patent [19]

Meldrum

[11] Patent Number: 4,972,647

[45] Date of Patent: Nov. 27, 1990

[54] SIDING SHIM

[76] Inventor: Charles K. Meldrum, 8107 Anchor Bay Dr., Fair Haven, Mich. 48023

[21] Appl. No.: 419,466

[22] Filed: Oct. 10, 1989

[51] Int. Cl.[5] ..... E04D 1/00; B61D 17/12; E04F 19/06

[52] U.S. Cl. ..... 52/518; 52/531; 52/478; 52/764; 52/520

[58] Field of Search ..... 52/518, 531, 532, 533, 52/52

[56] References Cited

U.S. PATENT DOCUMENTS

| | | | |
|---|---|---|---|
| 1,978,519 | 10/1934 | Willock | 52/533 |
| 2,264,546 | 12/1941 | Ochs | 52/531 |
| 2,607,449 | 8/1952 | Daniels | 52/531 |
| 3,977,145 | 8/1976 | Dobby | 52/531 |
| 4,229,916 | 10/1980 | White | 52/518 |
| 4,459,788 | 7/1984 | Bockwinkel et al. | 52/535 |
| 4,548,006 | 10/1985 | Roberts | 52/533 |
| 4,754,589 | 7/1988 | Leth | 52/533 |

*Primary Examiner*—Richard E. Chilcot, Jr.
*Assistant Examiner*—Deborah McGann Ripley
*Attorney, Agent, or Firm*—Harness, Dickey & Pierce

[57] ABSTRACT

A shim is provided to improve the aesthetic appearance of the overlap of adjacent siding panel ends manufactured from metallic or polymeric materials. The shim includes an elongated body having one or more positioning members extending therefrom. The body also includes a member to enable retention of the shim in place. The shim is preferably injection molded into a unitary one-piece construction.

10 Claims, 2 Drawing Sheets

SIDING SHIM

BACKGROUND OF THE INVENTION

The present invention relates to siding panels for the exterior of houses and, more particularly, to a shim positioned under adjacent siding panels to eliminate unsightly gaps at the overlapped ends of the adjacent siding panels.

In the housing industry, various types of materials may be utilized on the exterior of houses to provide a pleasing, aesthetic appearance. One such material is commonly known as siding. Siding may be formed from metallic material such as aluminum or tin, polymeric material such as vinyl or wood. Siding panels are available in varying lengths, generally several feet. The width of the siding panels generally varies from 4 to 8 inches and the thickness of the metal and polymeric siding panel is of a very small gage.

When assembling siding onto a house, siding panels are overlapped at their ends and locked together at their sides. Often times, a gap is created at the overlap of the vinyl siding panels due to the bowing or sagging in the siding panels. These gaps are unsightly and distract from the aesthetic appearance of the house. Also, the gaps provide ideal hiding places for spiders, insects and the like, as well as enabling easy access to the rain, wind and other elements. The precipitation from the elements may seep behind the siding panels leading to rotting or destruction of the undersurface of the house.

SUMMARY OF THE INVENTION

Accordingly, it is an object of the present invention to overcome the above disadvantages.

A siding shim is provided which substantially eliminates gaps between overlapped siding panels.

The siding shim is an inexpensive device for elimination of the unsightly seem gaps at the overlap of the siding panels.

The present invention is quick and easy to install during installation of siding on a building.

The shim will enable thinner gages of siding material to be utilized without subtracting from the appearance of the house.

The present invention provides the art with a unitary shim which provides easy handling during installation.

Finally, the siding shim is lightweight and relatively inexpensive to manufacture.

From the subsequent detailed description taken in conjunction with the accompanying drawings and subjoined claims, other objects and advantages of the present invention will become apparent to those skilled in the art.

DETAILED DESCRIPTION OF THE PREFERRED EMBODIMENT

Figure 1:
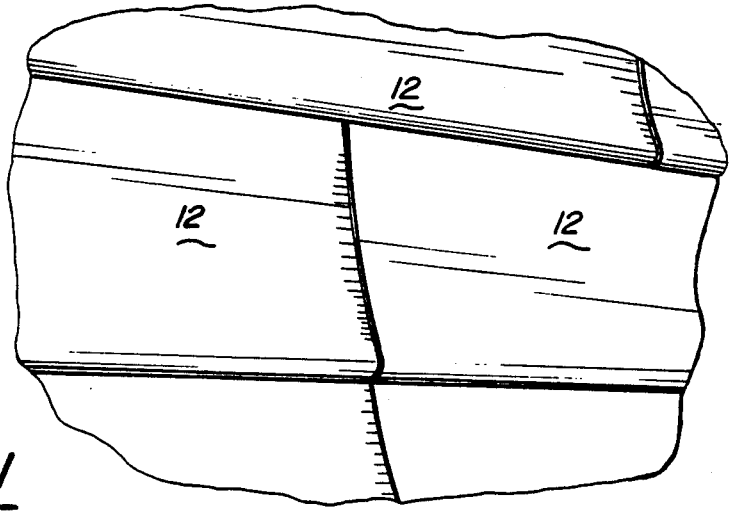
FIG. 1 illustrates a portion of a sided building wall.
Figure 2:
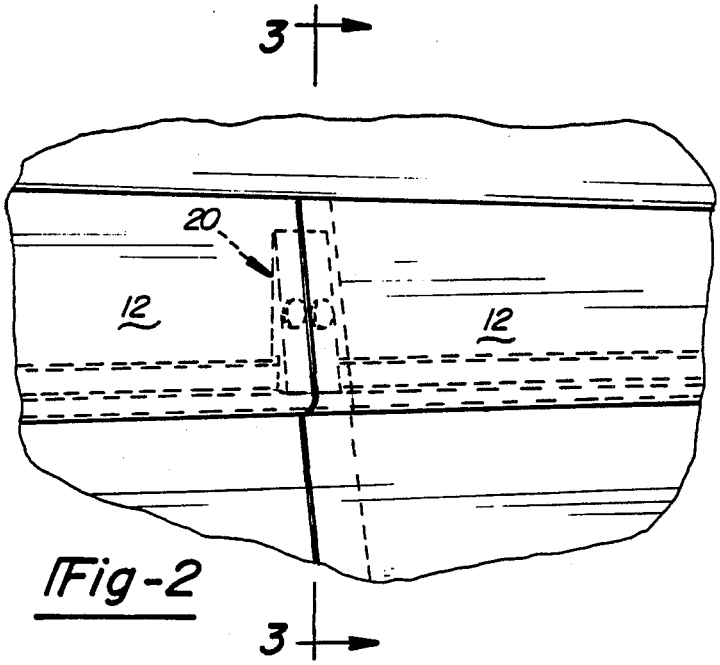
FIG. 2 is similar to FIG. 1 including the present invention.
Figure 3:
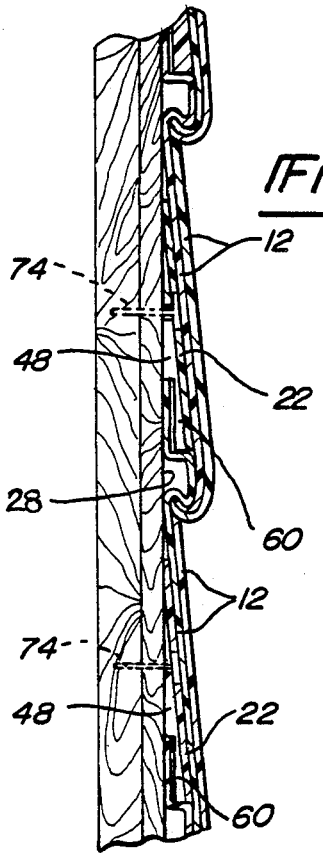
FIG. 3 is a vertical cross-section of FIG. 2 through Line 3—3 thereof.

Turning to the figures, particularly FIG. 1, a wall sided with siding panels 12 is illustrated. The siding panels 12 are secured to the wall in an end to end fashion with an overlap at the ends. The siding panels 12 are locked together at their sides with adjacent panels, as shown in FIG. 3. A shim in accordance with the present invention is shown positioned under the siding panels 12 at the overlap and designated with the reference numeral 20, as shown in FIG. 2.

The shim 20 includes a body 22, positioning members 24 and a mechanism 26 to enable securing of the shim 20 to the surface 28 to be sided. The body 22 is generally elongated, planar and substantially flat. The body 22 is preferably rectangular having major longitudinal edges 30 and 32, minor lateral edges 34 and 36, and major side faces 38 and 40. The major side face 40 is substantially smooth having one or more recesses 42 and 44 to receive a fastener head, as will be explained herein.

The positioning members 24 include one or more walls 46, 48 and 50 extending from the major side face 38. Wall members 46 and 50 extend from the major longitudinal edges 30 and 32, respectively, of the body 22. The wall member 48 extends from major side face 38 at substantially an equal distance between the two outer wall members 46 and 50 along the longitudinal axis of the body 22. It should be noted that any number of wall members could be used. Also, a single wider wall member could be used spanning all or a portion of the major side face 38.

Figure 4:
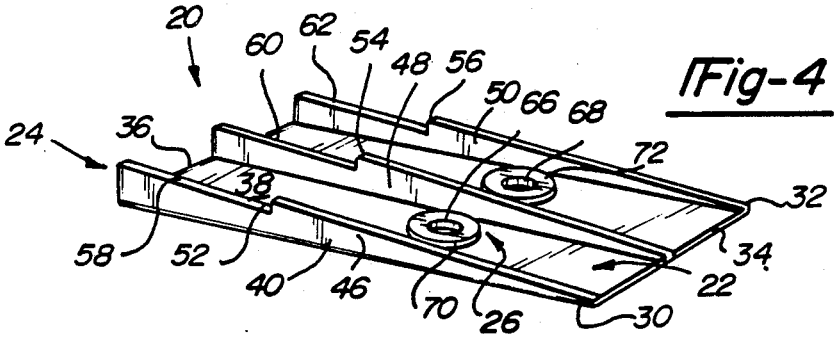
FIG. 4 is a perspective view of a shim in accordance with the present invention.
Figure 5:
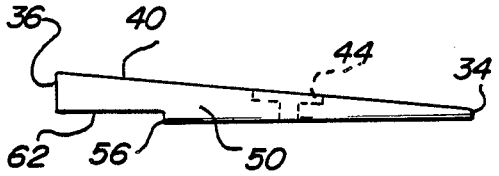
FIG. 5 is a side view of the shim of FIG. 4.
Figure 6:
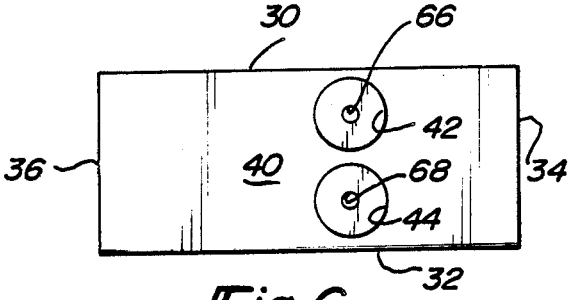
FIG. 6 is a plan view of the body of the shim of FIG. 4.

The wall members 46, 48 and 50, when viewed in side elevation, are tapered at a desired angle from the minor edge 34 to the minor edge 36. The wall members 46, 48 and 50 are generally wedge shaped when viewed in side elevation. At minor edge 34 the wall members 46, 48 and 50 are substantially continuous and flush with the body 22. As the wall members 46, 48 and 50 move towards minor edge 36, they increase in height, as seen in FIGS. 3–5. The slope of the edge of the wall members 46, 48 and 50 is on an angle with respect to the body 22 at from about two to about ten degrees, preferably at about 5 degrees. This angle is desirous in optimizing the extension of the siding panels 12 from the surface 28 to be sided to eliminate gaps at the overlap of the panels 12, as seen in FIGS. 1–3.

The wall members 46, 48 and 50 reach an apex 52, 54 and 56 where a cutout portion 58, 60 and 62 is formed in each of the wall members 46, 48 and 50, respectively. The cutouts 58, 60 and 62 enable the wall members 46, 48 and 50 to be positioned over a flange 64 on the siding panels 12, as seen in FIG. 3. The cutouts 58, 60 and 62 enable the sloped edges of the wall members 46, 48 and 50 to abut the surface 28 to be sided, as seen in FIG. 3.

The mechanism 26 for enabling retaining of the shim 20 to the surface 28 to be sided includes a pair of apertures 66 and 68, bosses 70 and 72 and previously mentioned recesses 42 and 44. The apertures 66 and 68 enable fasteners 74 to pass through the body 22 to secure the shim 20 onto the surface 28 to be sided. The shim 20 may be held in place by a single fastener 74 or two or more fasteners may be used. The head of the fastener seats in the recesses 42 and 44 to provide a substantially continuous smooth nonraised surface on the major side face 40, as can be seen in FIG. 3. Fasteners having thin heads, such as roofing nails, work satisfactorily for this purpose. The bosses 70 and 72 provide a means to prevent the body member 22 from indenting, sagging or collapsing in the area where the fasteners are positioned through the body 22 once the fasteners are secured to the surface 28 to be sided.

Also, the shim of the present invention may be utilized to repair existing buildings. In this case, a zip tool is used to provide access to the under surface, the shim inserted, and the panels relocked in position.

Figure 7:
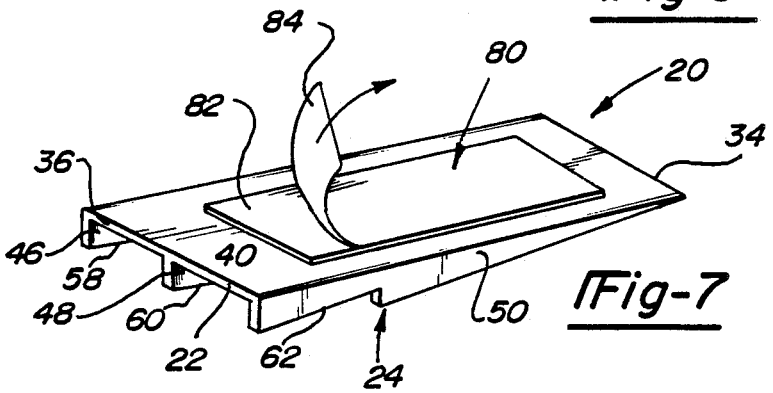
FIG. 7 is a perspective view of another embodiment in accordance with the present invention.

Turning to FIG. 7, another embodiment of the present invention is shown. The shim of FIG. 7 is substantially the same as that previously discussed and the same reference numerals will be used to identify like elements.

The shim 20 includes a body 22, positioning members 24 and a mechanism 80 for securing the shim to the siding panels 12.

The mechanism 80 includes an adhesive layer 82 affixed to the major side face 38. The ma]or side face 38 may be smooth and continuous eliminating the apertures and recesses. A release layer 84 is positioned on the adhesive layer 82 to prevent contamination of the adhesive layers. The release layer 84 is removed from the adhesive layer to enable the shim 20 to be directly secured to the siding panel.

The shim 20 is generally injected molded to form a unitary one-piece construction. The shim 20 is inexpensively formed and provides easy installation to enhance the aesthetic appearance of a sided surface by eliminating unsightly gaps at the overlap of the siding panels.

In siding a surface, generally the sider works from the bottom of the surface upwards. A first panel is positioned at the bottom of the surface to be sided. If the first panel does not span the surface, a second panel would be placed adjacent the end and overlapping the end, as shown in FIG. 1. The shims of the present invention would be positioned underneath the panel at the overlap of the two panels, as seen in FIGs. 2 and 3. The next row of siding panels would be positioned and interlocked on the first row of siding panels and the shims would be positioned at the overlaps of all of the panels. Also, the siding panels include a flange having a plurality of apertures to enable fasteners to be passed therethrough to secure the siding onto the surface to be sided. As seen in FIG. 3, at the junction of a row on top of a row, the cutout portions are positioned over the flange to enable the shim to be positioned on the surface to be sided to elevate the panel across the span of the siding. This process would continue with the positioning of the siding panels and shims at the overlaps of the siding panels until the surface to be sided is completed.

While the above detailed description describes the preferred embodiment of the present invention, it will be understood that the present invention is susceptible to modification, variation and alteration without deviating from the scope and fair meaning of the subjoined claims.

What is claimed is:

1. A device for shimming siding comprising:

a body member to be positioned underneath a siding panel, said body member having two major sides, one of said sides to abut the siding panel;

means for positioning said body member away from a surface to be sided, said positioning means integral with said body and having a sloped edge abutting the surface to be sided, said positioning means extending from the other major side of said body member; and means for enabling said body to be secured in place with respect to the surface to be sided, said means for enabling includes one or more apertures enabling a fastener to pass through said body to retain the shim on the surface to be sided, a recess surrounding each of said apertures on the abutting major side for enabling a head of the fasteners to be flush with said body, and a boss surrounding each of said apertures on the other major side for providing additional strength to said body.

2. The device according to claim 1 further comprising means for enabling said body to be positioned over flange on a siding panel, said enabling means integral with said positioning means.

3. The device according to claim 1 wherein the device is unitarily molded to form a one-piece construction.

4. The device according to claim 1 wherein said sloped edge of said means for positioning the body member away from the surface to be sided is on an angle tapering from about two to about ten degrees.

5. A siding shim comprising:

an elongated body having two ends and two major sides and is to be positioned underneath a siding panel, one of said major sides abutting the siding panel;

one or more wall members extending from the other major side of said body, said one or more wall members being wedge shaped taping from one end of said body increasing in height towards the other end of the body providing a sloped edge at a desired angle when said one or more wall members abut against a surface to be sided;

a cutout in said one or more wall members adapted to enable said one or more wall members to be positioned on top of a lip of a siding panel underneath an adjacent siding panel; and said body including means for securing said shim in place with respect to a siding panel, said securing means comprised of an adhesive on said abutting major side of said body.

6. The siding shim according to claim 5 wherein said body includes two or more wall members.

7. A method of siding a surface comprising:

positioning a first siding panel having two ends and sides on a surface to be sided;

overlapping a second siding panel at one end of said first panel;

positioning a siding shim having one or more holes under the overlap of said siding panels;

positioning a fastener into the one or more holes in the siding shim to secure the siding shim to the surface to be sided; and positioning additional siding panels end to end and side to side until the surface is sided.

8. The method according to claim 7 further comprising positioning a siding shim under all overlaps of said siding panels.

9. A method of siding a surface comprising:

positioning a first siding panel having two ends and sides on a surface to be sided;

overlapping a second siding panel at one end of said first panel;

positioning a siding shim under the overlap of said siding panels;

adhesively securing the siding shim to an under surface of the first or second siding panel; and positioning additional siding panels end to end and side to side until the surface is sided.

10. A device for shimming siding comprising:

a body member to be positioned underneath a siding panel, said body member having two major sides, one of said sides adapted to abut the siding panel;

means for positioning said body member away from a surface to be sided, said positioning means integral with said body and having a sloped edge abutting the surface to be sided, said positioning means extending from the other major side of said body member; and means for enabling said body to be secured in place, said means for enabling comprised of an adhesive on said major side of said body adapted to abut the siding panel.

* * * * *